US010496018B2

(12) United States Patent
Eguchi et al.

(10) Patent No.: US 10,496,018 B2
(45) Date of Patent: Dec. 3, 2019

(54) FIXING APPARATUS

(71) Applicant: CANON KABUSHIKI KAISHA, Tokyo (JP)

(72) Inventors: Hiroki Eguchi, Yokohama (JP); Shinji Hashiguchi, Mishima (JP); Yasuhisa Matsumoto, Mishima (JP); Ryo Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/135,890

(22) Filed: Sep. 19, 2018

(65) Prior Publication Data

US 2019/0101852 A1 Apr. 4, 2019

(30) Foreign Application Priority Data

Sep. 29, 2017 (JP) ..... 2017-191927

(51) Int. Cl.
*G03G 15/20* (2006.01)
*G03G 15/04* (2006.01)

(52) U.S. Cl.
CPC ... *G03G 15/2017* (2013.01); *G03G 15/04072* (2013.01); *G03G 15/205* (2013.01)

(58) Field of Classification Search
CPC ..... G03G 15/205; G03G 15/5004
See application file for complete search history.

(56) References Cited

U.S. PATENT DOCUMENTS

| | | | | |
|---|---|---|---|---|
| 9,913,320 | B2 * | 3/2018 | Garvey | G01P 15/02 |
| 2005/0139584 | A1 * | 6/2005 | Kishi | G03G 15/2003 219/202 |
| 2007/0230982 | A1 * | 10/2007 | Hori | G03G 15/2039 399/69 |
| 2013/0202325 | A1 * | 8/2013 | Takeuchi | G03G 15/2046 399/69 |
| 2016/0274506 | A1 * | 9/2016 | Furuyama | G03G 15/205 |

FOREIGN PATENT DOCUMENTS

| | | | |
|---|---|---|---|
| JP | 9-90807 | A | 4/1997 |
| JP | 4302465 | B2 | 7/2009 |
| JP | 2010-276971 | A | 12/2010 |
| JP | 2013-161039 | A | 8/2013 |
| JP | 2014013423 | A * | 1/2014 |

* cited by examiner

*Primary Examiner* — Sevan A Aydin
(74) *Attorney, Agent, or Firm* — Canon U.S.A. Inc., IP Division

(57) ABSTRACT

In a warm-up period of a fixing apparatus of the present disclosure, a control unit supplies first electric power to a heater and thereafter supplies second electric power larger than the first electric power to the heater. The timing of starting to supply the second electric power is determined according to the degree of an increase in temperature sensed by a temperature sensing member after a driving signal is transmitted to a driving source.

12 Claims, 9 Drawing Sheets

1

FIXING APPARATUS

BACKGROUND OF THE INVENTION

Field of the Invention

The present disclosure relates to fixing apparatuses for fixing images to a printing material, for use in electrophotographic image forming apparatuses, such as a laser beam printer and a copying machine.

Description of the Related Art

A known fixing apparatus mounted in electrophotographic image forming apparatuses, such as a laser beam printer and a copying machine, includes a rotatable tubular film and a heater that heats part of the film in the direction of rotation. The entire film is warmed by being heated by the heater while rotating by a driving force transmitted from a driving source. Since the fixing apparatus uses a film with a low heat capacity, it has features such as high energy saving performance and short warm-up time.

In many cases, electric power supplied to the heater during the warm-up time of the fixing apparatus is maximum power that can be supplied to the heater or power almost equivalent thereto to reduce the warm-up time. Therefore, if the start of film rotation is delayed due to some cause, large power is supplied to the heater in the state in which the rotation of the film stops, so that a difference in temperature between a region of the film heated by the heater and an unheated region increases, causing a thermal stress. This thermal stress can deform the film. In particular, when the fixing apparatus is warmed up in a low-temperature environment, the temperature difference tends to increase.

Japanese Patent No. 4302465 discloses a fixing apparatus including a rotation detection plate fixed to a roller shaft that rotates together with a fixing belt and a sensor for detecting the rotation of the rotation detection plate, in which heating of the fixing belt is started on condition that rotation of the rotation detection plate is detected.

However, the configuration of Japanese Patent No. 4302465 needs another component and another sensor to detect the rotation of the fixing belt, which may increase the size and cost of the apparatus. The present disclosure provides a fixing apparatus in which thermal damage to the fixing film can be prevented.

SUMMARY OF THE INVENTION

The present disclosure provides a fixing apparatus including a rotatable tubular film, a heater in contact with part of an inner surface of the film in a rotational direction of the film, a temperature sensing member configured to sense a temperature of the inner surface of the film at a position different from a position of the heater in the rotational direction of the film, a driving source configured to generate a driving force for rotating the film, and a control unit configured to control a driving signal to be transmitted to the driving source and electric power to be supplied to the heater. The fixing apparatus fixes an image formed on a printing material to the printing material using heat of the heater via the film. In a warm-up period of the fixing apparatus, the control unit supplies first electric power to the heater and thereafter supplies second electric power larger than the first electric power to the heater. The timing of starting to supply the second electric power is determined according to a degree of an increase in temperature sensed by the temperature sensing member after the driving signal is transmitted to the driving source.

Further features of the present invention will become apparent from the following description of exemplary embodiments with reference to the attached drawings.

DESCRIPTION OF THE EMBODIMENTS

First Embodiment (1) Example of Image Forming Apparatus

Figure 1:
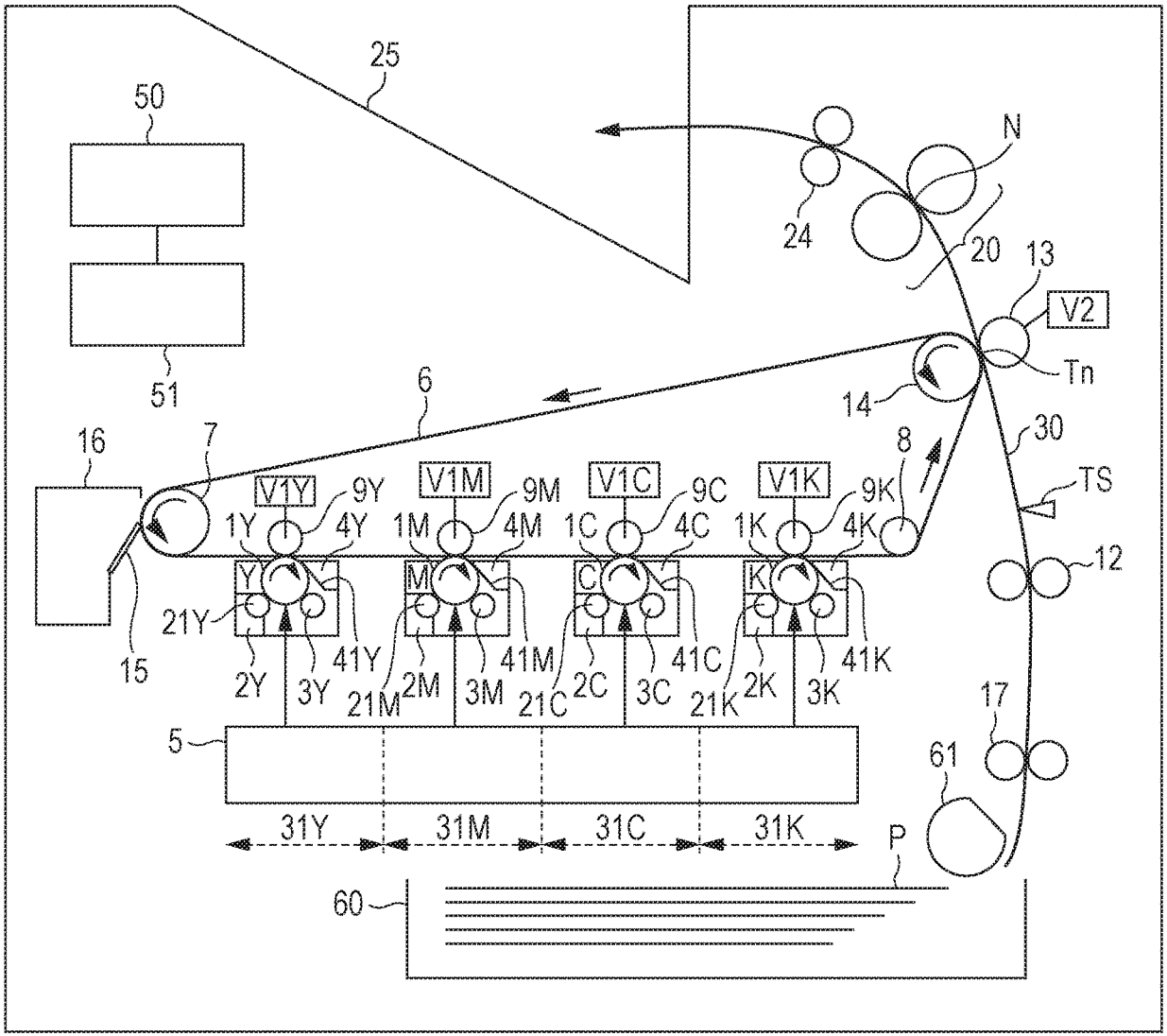
FIG. 1 is a schematic cross-sectional view of an image forming apparatus according to a first embodiment of the present disclosure.

FIG. 1 is a schematic cross-sectional view of an image forming apparatus according to an embodiment of the present disclosure. This image forming apparatus is a full-color laser printer that forms a full-color image by superposing toner images of four colors of yellow, cyan, magenta, and black.

An image forming apparatus 1 of the present embodiment includes a conveyance guide 30 for a printing material P, four image forming stations 31Y, 31M, 31C, and 31K arranged substantially linearly in the horizontal direction, a fixing apparatus 20, a control unit 50, and a video controller 51. The video controller 51 forms an image signal for image formation from image data transmitted from a host computer or an image scanner (not illustrated) connected to the image forming apparatus 1. The control unit 50 includes memories, such as a read-only memory (ROM) and a random-access memory (RAM), and a central processing unit (CPU). The memory stores an image-formation control sequence for forming an image on the printing material P and fixing temperature control of the fixing apparatus 20.

Of the four image forming stations 31Y, 31M, 31C, and 31K, 31Y denotes a yellow image forming station for forming a yellow (hereinafter abbreviated to Y) image, 31C is a cyan image forming station for forming a cyan (hereinafter abbreviated to C) image, 31M is a magenta image forming station for forming a magenta (hereinafter abbreviated to M) image, and 31K is a black image forming station for forming a black (hereinafter abbreviated to K) image.

The image forming stations 31Y, 31M, 31C, and 31K respectively include an electrophotographic photosensitive members (hereinafter referred to as photosensitive drums) 1Y, 1M, 1C, and 1K, and charging rollers 3Y, 3M, 3C, and 3K. The image forming stations 31Y, 31M, 31C, and 31K respectively further include developing units 2Y, 2M, 2C, and 2K and cleaning units 4Y, 4M, 4C, and 4K serving as drum cleaners.

The photosensitive drum 1Y, the charging roller 3Y, the developing unit 2Y, and the cleaning unit 4Y are housed in one frame to constitute a yellow cartridge Y. The photosensitive drum 1M, the charging roller 3M, the developing unit 2M, and the cleaning unit 4M are housed in one frame to constitute a magenta cartridge M. The photosensitive drum 1C, the charging roller 3C, the developing unit 2C, and the cleaning unit 4C are housed in one frame to constitute a cyan cartridge C. The photosensitive drum 1K, the charging roller 3K, the developing unit 2K, and the cleaning unit 4K are hosed in one frame to constitute a black cartridge K. The developing unit 2Y of the yellow cartridge Y contains a yellow toner, and the developing unit 2M of the magenta cartridge M contains a magenta toner. The developing unit 2C of the cyan cartridge C contains a cyan toner, and the developing unit 2K of the black cartridge K contains a black toner.

Reference sign 5 denotes laser scanning exposure units (hereinafter referred to as "exposure units"). The exposure units 5 are disposed for the cartridges Y, M, C, and K and form electrostatic latent images by exposing the respective photosensitive drums 1Y, 1M, 1C, and 1K of the cartridges Y, M, C, and K to light.

Reference sign 6 denotes an endless intermediate transfer belt (an intermediate transfer member). The intermediate transfer belt 6 is disposed in the direction of arrangement of the image forming stations 31Y, 31M, 31C, and 31K. The intermediate transfer belt 6 is stretched round three rollers of a facing driving roller 7, a tension roller 8, and a secondary-transfer facing roller 14. The intermediate transfer belt 6 circumferentially moves in the direction of the arrow along the respective photosensitive drums 1Y, 1M, 1C, and 1K of the image forming stations 31Y, 31M, 31C, and 31K by the driving of the facing driving roller 7.

Primary transfer rollers 9Y, 9M, 9C, and 9K are used to primarily transfer toner images on the surfaces of the photosensitive drums 1Y, 1M, 1C, and 1K to the outer circumferential surface (surface) of the intermediate transfer belt 6. The primary transfer rollers 9Y, 9M, 9C, and 9K are respectively opposed to the photosensitive drums 1Y, 1M, 1C, and 1K, with the intermediate transfer belt 6 sandwiched therebetween.

A belt cleaning blade 15 is a cleaning unit for cleaning the intermediate transfer belt 6. The belt cleaning blade 15 is opposed to the facing driving roller 7.

A conveying unit for the printing material P includes a sheet feeding roller 61, a conveying roller 17, a registration roller 12, and a discharge roller 24. The image forming apparatus 1 of the present embodiment further includes a printing-material cassette 60 serving as a printing material supply unit. The printing-material cassette 60 includes the sheet feeding roller 61 for introducing the printing material P into the image forming apparatus 1. The printing material P is conveyed toward the registration roller 12 by the conveying roller 17.

When the video controller 51 receives image data from an external device, such as a host computer, (not illustrated), the video controller 51 transmits a print signal to the control unit 50 and converts the received image data to bitmap data. The number of pixels formed by the image forming apparatus 1 is 600 dpi. The video controller 51 creates bitmap data corresponding to the number of pixels. Upon receiving the print signal, the control unit 50 executes an image-formation control sequence. When the image-formation control sequence is executed, first the photosensitive drums 1Y, 1M, 1C, and 1K rotates in the direction of the arrow. The outer circumferential surfaces (surfaces) of the photosensitive drums 1Y, 1M, 1C, and 1K are respectively uniformly charged to a predetermined polarity and potential by the charging rollers 3Y, 3M, 3C, and 3K. In the present embodiment, the surfaces of the photosensitive drums 1Y, 1M, 1C, and 1K are charged to negative polarity. The charged surfaces of the photosensitive drums 1Y, 1M, 1C, and 1K are scanned with laser beams corresponding to the image signal derived from the bitmap data by the exposure units 5. This causes electrostatic latent images corresponding to the image data to be formed on the surfaces of the photosensitive drums 1Y, 1M, 1C, and 1K. In the developing units 2Y, 2M, 2C, and 2K, a developing bias is applied to each of developing rollers 21Y, 21M, 21C, and 21K by a developing bias source ((not illustrated), respectively. By setting the developing bias to an appropriate value between the charging potential and the latent image potential (of the exposed portion), negatively charged toner is electively attached from the developing rollers 21Y, 21M, 21C, and 21K to the electrostatic latent images on the surfaces of the photosensitive drums 1Y, 1M, 1C, and 1K. Thus, the electrostatic latent images are developed.

The single-color toner images developed on the surfaces of the photosensitive drums 1Y, 1M, 1C, and 1K by the developing units 2Y, 2M, 2C, and 2K, respectively, are transferred to the outer circumferential surface (surface) of the intermediate transfer belt 6 which rotates in synchronism with the rotation of the photosensitive drums 1Y, 1M, 1C, and 1K at a substantially equal speed. In other words, a positive-polarity transfer bias opposite to the polarity of the toner is applied from first transfer bias sources V1Y, V1M, V1C, and V1K to the primary transfer rollers 9Y, 9M, 9C, and 9K corresponding to the photosensitive drums 1Y, 1M, 1C, and 1K, respectively. This causes respective color toner images to be primarily transferred from the surfaces of the photosensitive drums 1Y, 1M, 1C, and 1K to the surface of the intermediate transfer belt 6 so as to be superposed. Thus, a color toner image is formed on the surface of the intermediate transfer belt 6.

Transfer residual tonner remaining on the surfaces of the photosensitive drums 1Y, 1M, 1C, and 1K after the toner images are primarily transferred is removed by cleaning members 41Y, 41M, 41C, and 41K respectively provided in the cleaning units 4Y, 4M, 4C, and 4K. The transfer residual tonner removed by the cleaning members 41Y, 41M, 41C, and 41K is collected to waste tonner containers of the cleaning units 4Y, 4M, 4C, and 4K. In the present embodiment, the cleaning members 41Y, 41M, 41C, and 41K are cleaning blades made of urethane.

As described above, the charging process using the charging roller, the exposing process using the exposure units, the developing process using the developing unit, and the primary transfer process using the primary transfer roller 9 are performed on yellow, magenta, cyan, and black colors in synchronism with the rotation of the intermediate transfer belt 6. Thus, color toner images are superposed on the surface of the intermediate transfer belt 6 one by one in sequence. In other words, the intermediate transfer belt 6 carries unfixed toner images of a color image to be formed on the printing material P.

The printing materials P placed in the printing-material cassette 60 are fed by the sheet feeding roller 61 and conveyed to the registration roller 12 by the conveying roller 17.

An end of the printing material P conveyed to the registration roller 12 is detected by a top sensor TS disposed directly behind the registration roller 12. The registration roller 12 conveys the printing material P to a transfer nip Tn between the intermediate transfer belt 6 and a secondary transfer roller 13 serving as a secondary transfer unit at the same timing as the image position on the surface of the intermediate transfer belt 6 according to the detection of the end of the printing material P. The transfer nip Tn is formed between the intermediate transfer belt 6 and the secondary transfer roller 13 by disposing the secondary transfer roller 13 so as to be in contact with the surface of the intermediate transfer belt 6 at a position opposed to the secondary-transfer facing roller 14. The conveying speed of the printing material P in the image forming apparatus 1 of the present embodiment is 200 mm/sec.

The toner image carried on the surface of the intermediate transfer belt 6 is transferred onto the printing material P by applying a bias having a polarity opposite to the polarity of the toner to the secondary transfer roller 13 by a secondary transfer bias source V2.

The color toner image transferred onto the printing material P is introduced to a fixing nip N of the fixing apparatus 20 serving as a fixing unit and is fixed onto the printing material P with heat and pressure. The printing material P exiting the fixing nip N of the fixing apparatus 20 is discharged onto an output tray 25 by a discharge roller pair 24.

Transfer residual tonner remaining on the surface of the intermediate transfer belt 6 after the toner images are transferred is removed by the belt cleaning member 15. The transfer residual tonner removed by the belt cleaning member 15 is collected to a waste tonner container 16. In the present embodiment, the cleaning member 15 is a cleaning blade made of urethane.

(2) Fixing Apparatus

Figure 2A:
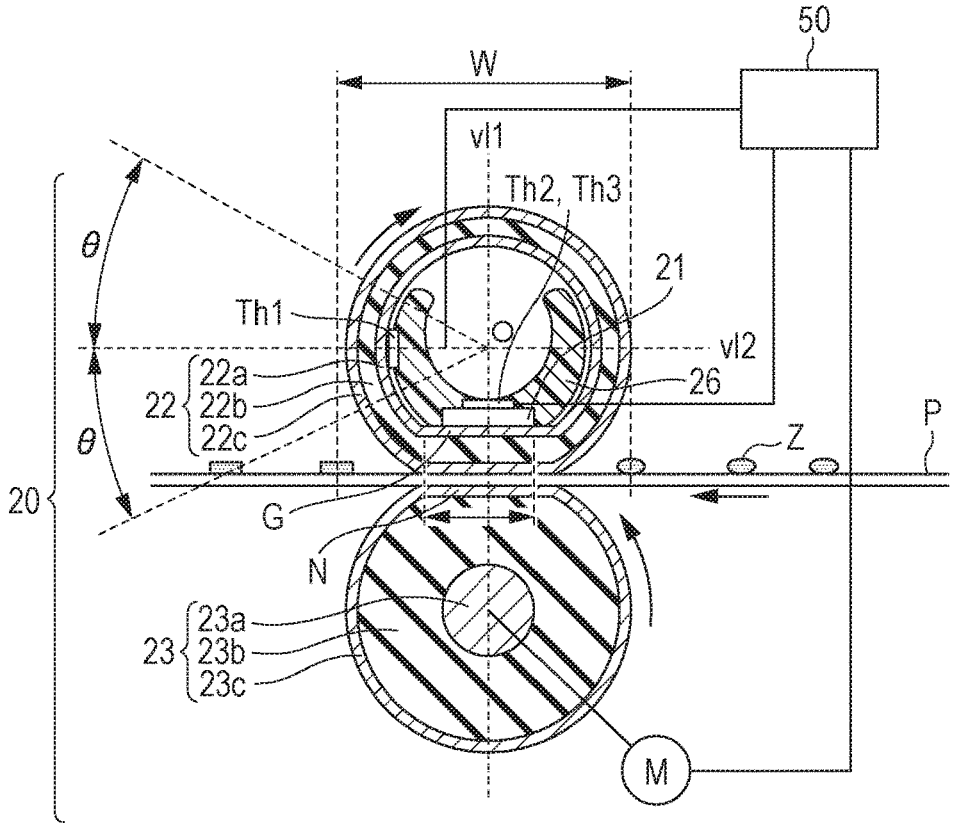
FIG. 2A is a schematic cross-sectional view of a fixing apparatus according to the first embodiment.

FIG. 2A is a schematic cross-sectional view of the fixing apparatus 20. In the following description, the longitudinal direction of the fixing apparatus 20 and components constituting the fixing apparatus 20 is a direction perpendicular to the printing-material conveying direction of the surface of the printing material P. The lateral direction is a direction parallel to the printing-material conveying direction of the surface of the printing material P. The fixing apparatus 20 includes a rotatable tubular fixing film 22, a heater 21 serving as a heating unit for heating part of the fixing film 22 in the rotational direction of the fixing film 22, and a pressure roller 23 that comes into contact with the fixing film 22 to form a nip. The fixing film 22, the heater 21, and the pressure roller 23 are members that are elongated in the longitudinal direction.

The pressure roller 23 forms the fixing nip N together with the heater 21, with the fixing film 22 interposed therebetween, and conveys the printing material on which a toner image is formed to fix the toner image to the printing material heated at the fixing nip N.

The fixing apparatus 20 further includes a heater holder 26 serving as a supporting member disposed in contact with the inner surface of the fixing film 22 to support the heater 21. The heater holder 26 is a semicircular heat-resistant resin, such as a liquid-crystal polymer, and also has the function of guiding the rotation of the fixing film 22.

On the surface of the fixing film 22, a thermistor Th1 for detecting an area of the fixing film 22 different from an area (the fixing nip N) of the fixing film 22 heated by the heater 21 in the rotational direction of the fixing film 22. In the present embodiment, the thermistor Th1 is used to control electric power to be supplied to the heater 21 (to be described later) and to detect the rotation of the fixing film 22.

The position of the thermistor Th1 will be described. If the thermistor Th1 is too close to the fixing nip N, the accuracy of detecting the rotation of the fixing film 22 decreases under the influence of non-operating heating (to be described later). In contrast, if the thermistor Th1 is too far from the fixing nip N, the time required to detect the rotation of the fixing film 22 increases, so that the warm-up time of the fixing apparatus 20 increases disadvantageously. A desirable position of the thermistor Th1 will be described here. Referring to FIG. 2A, a first phantom line vl1 is a phantom line passing through the center of the nip in the printing-material conveying direction and extending in a direction perpendicular to the printing-material conveying direction in a cross section perpendicular to the longitudinal direction of the fixing film 22. A second phantom line vl2 is a phantom line passing through the widest portion of the fixing film 22 in the printing-material conveying direction and perpendicular to the first phantom line vl1, and O is the intersection of the first phantom line vl1 and the second phantom line vl2. The thermistor Th1 may be disposed downstream from the first phantom line vl1 in the printing-material conveying direction. The thermistor Th1 may be disposed so as to detect the temperature of an area of the fixing film 22 where the second phantom line vl2 extending from the intersection O downstream in the printing-material conveying direction is rotated ±θ (=45 degrees) about the intersection O.

Figure 2B:
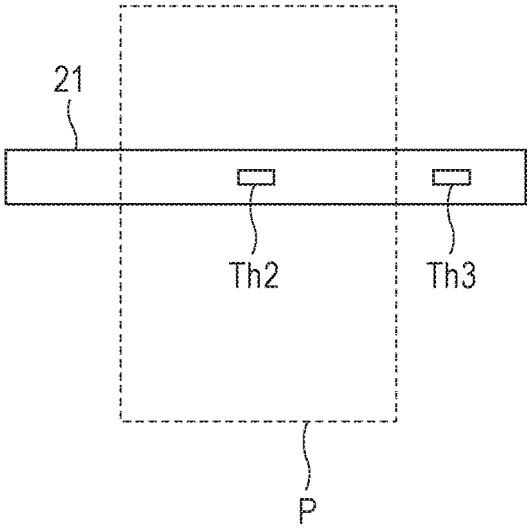
FIG. 2B is a diagram illustrating the positions of thermistors with respect to a heater according to the first embodiment.

FIG. 2B is a diagram illustrating the positions of thermistors Th2 and Th3 on the heater 21 disposed so as to be in contact with a surface of the heater 21 opposite to the surface in contact with the inner surface of the fixing film 22. The printing material P illustrated in FIG. 2B is a small-size printing material smaller in width than a maximum-size printing material having the maximum width that can be used in the image forming apparatus 1 (the fixing apparatus 20). In the present embodiment, as illustrated in FIG. 2B, the thermistors Th2 and Th3 respectively sense the temperature of a sheet passing area of the heater 21 through which the small-size printing material passes and the temperature of a sheet-non-passing area through which the small-size printing material does not pass. The thermistor Th2 is used to sense the warming condition of the fixing apparatus 20, described later.

The fixing film 22 includes a tubular base layer 22*a* made of a resin-based material, such as polyimide, or a metallic material, such as stainless steel (SUS). The base layer 22*a* in the present embodiment is made of SUS304 with a thickness of 30 μm. The inside diameter of the fixing film 22 is ϕ24 mm. An elastic layer 22*b* formed of thin heat-resistant rubber, such as silicone rubber or fluorine-containing rubber, is provided around the outer circumferential surface of the base layer 22*a*. The elastic layer 22*b* is made of silicone rubber with a thickness of 300 μm. On the outer circumferential surface of the elastic layer 22*b*, a releasing layer 22*c* made of polytetrafluoroethylene (PTFE) or tetrafluoroethylene-perfluoroalkyl vinyl ether copolymer (PFA) with a thickness of 20 μm is formed.

The heater 21 includes a heating resistor (not illustrated) made of silver paste on a substrate made of alumina or aluminum nitride.

As illustrated in FIG. 2A, a heat-resistant lubricant G is applied to a surface of the heater 21 rubbing against the fixing film 22 to reduce the frictional force. The heat-resistant lubricant G is also applied to the inner surface of the fixing film 22 in close-contact with the heater 21 by the rotation driving operation. The heat-resistant lubricant G of the present embodiment is grease in which PFA or the like is dispersed in fluorine-containing oil. In the present embodiment, the heater 21 serves as both of a nip-forming member and a heating member.

The heater is not limited to the heater of the present embodiment but may be any other heater that heats part of the fixing film 22 in the rotational direction of the fixing film 22. One example is an electromagnetic induction heating type heater including an electromagnetic coil and heating a conductive member such as metal. Another example is a configuration for causing part of the base layer of the fixing film 22 to generate heat using a magnetic flux generated by passing a current through an electromagnetic coil. Also in a configuration using a heater as in the present embodiment, a member different from the heater may form a fixing nip together with a pressure roller.

The pressure roller 23 includes a round-shaft-shaped metal core 23*a* made of aluminum or stainless steel. A thick elastic layer 23*b* made of silicone rubber or foamed silicone rubber is formed around the outer circumferential surface of the metal core 23*a*. On the outer circumferential surface of the elastic layer 23*b*, a releasing layer 23*c* made of PTFE or PFA is formed as the outermost layer. The outside diameter of the pressure roller 23 is ϕ26.5 mm. The longitudinal both ends of the metal core 23*a* of the pressure roller 23 are rotatably supported by the apparatus frame. The outer circumferential surface (the surface) of the fixing film 22 is brought into contact with the surface of the pressure roller 23 by urging the longitudinal both ends of the film unit constituted of the fixing film 22, the heater holder 26, and the heater 21 toward the pressure roller 23 using a pressure unit, such as a pressure spring, (not illustrated). A part of the elastic layer 23*b* pressed by the film unit is elastically deformed in the longitudinal direction of the fixing film 22 to form the fixing nip N with a predetermined width between the surface of the pressure roller 23 and the surface of the fixing film 22.

(3) Fixing Processing Operation

Figure 9:
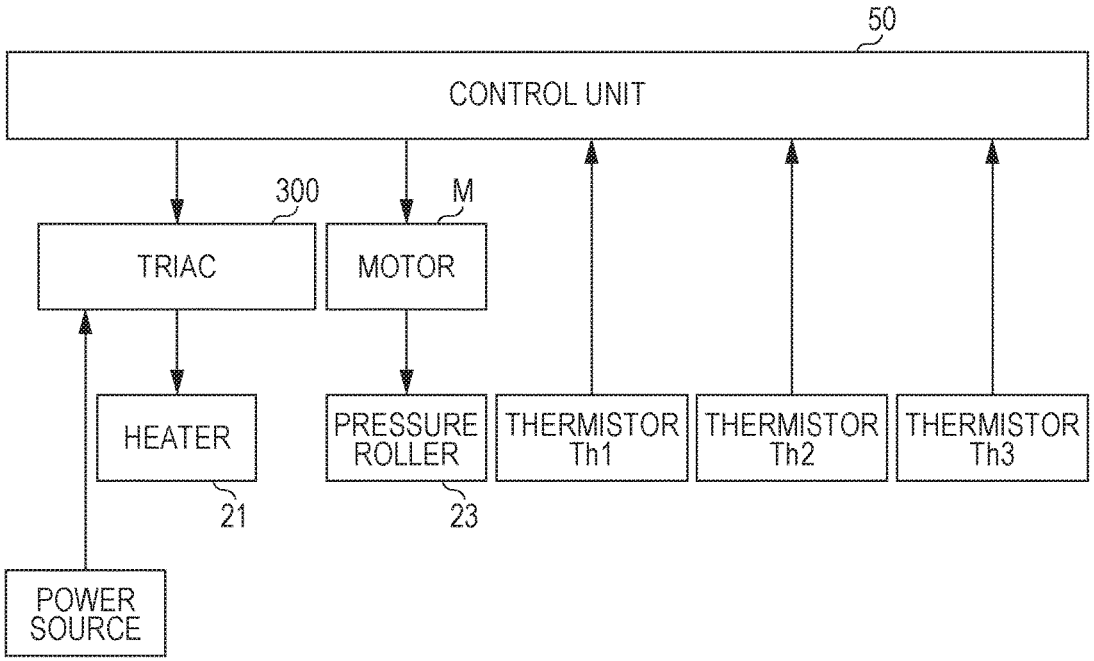
FIG. 9 is a control block diagram according to the first embodiment.

A fixing processing operation of the fixing apparatus 20 will be described with reference to a control block diagram in FIG. 9.

The control unit 50 rotationally drives a drive gear (not illustrated) provided at one end of the metal core 23*a* of the pressure roller 23 according to an input of a print signal using a motor M serving as a driving source to rotate the pressure roller 23 in the direction of the arrow (see FIG. 2A). As the pressure roller 23 rotates, a rotational force acts on the fixing film 22 by the frictional force between the surface of the pressure roller 23 and the surface of the fixing film 22 at the nip N. The fixing film 22 is rotated by the rotational force in the direction of the arrow at substantially the same circumferential speed as that of the pressure roller 23.

The control unit 50 turns on a triac 300 serving as a conduction control unit. Thus, electric power is supplied from a power source to the heater 21. In the present embodiment, the maximum power that can be supplied to the heater 21 is 1,000 W. The heater 21 supplied with power generates heat, and the fixing film 22 is heated by the heat of the heater 21. The temperature of the fixing film 22 is sensed by the thermistor Th1. The control unit 50 receives an output signal (a temperature sense signal) from the thermistor Th1 and controls the power to be supplied to the heater 21 using the triac 300 based on the output signal so that the temperature of the fixing film 22 reaches a predetermined fixing temperature (a target temperature) T.

In a state in which a temperature NT sensed by the thermistor Th1 reaches the fixing temperature (target temperature) T and the rotation speed of the fixing film 22 by the rotation of the pressure roller 23 is in a steady state, the printing material P carrying an unfixed toner image Z is introduced into the nip N. The printing material P is conveyed while being nipped between the surface of the fixing film 22 and the surface of the pressure roller 23 at the nip N, where the printing material P is heated by the surface of the fixing film 22 and pressed by the nip N, so that the fixing process for fixing the toner image Z on the printing material P with heat is performed. For continuously fixing of small-size printing materials, a rise in temperature of the sheet-non-passing area is suppressed by changing the distance between a preceding printing material and a following printing material according to the difference between a temperature sensed by the thermistor Th2 and a temperature sensed by the thermistor Th3.

(4) Warm-Up Initial Control of Fixing Unit

Warm-up initial control of the fixing apparatus 20 of the present embodiment will be described with reference to a flowchart in FIG. 3.

When the image forming apparatus 1 receives a print signal, warm-up initial control of the fixing apparatus 20 is started (E1). First, the temperature of the heater 21 is sensed using the thermistor Th2 (E2). This is for the purpose of sensing the degree of warming of the fixing apparatus 20. Since the heater 21 is in contact with a member having a large heat capacity, such as the heater holder 26, the thermistor Th2 is suitable to sense the degree of warming of the fixing apparatus 20. Since the thermistor Th2 is disposed at a position of the heater 21 closer to the longitudinal center than the thermistor Th3, as illustrated in FIG. 2B, the thermistor Th2 is hardly affected by environment outside the fixing apparatus 20, and therefore the thermistor Th2 is suitable to sense the degree of warming of the fixing apparatus 20. Alternatively, the thermistor Th3 may be used to sense the degree of warming of the fixing apparatus 20.

If the temperature sensed by the thermistor Th2 is lower than a threshold temperature (in the present embodiment, 70° C.), non-operating heating in which the fixing film 22 is heated by supplying a power of 200 W (first electric power) to the heater 21, with the fixing film 22 stopped (E3). By the non-operating heating step, a heated area and a non-heated area are formed in the fixing film 22 in the rotational direction of the fixing film 22 to cause a temperature difference therebetween. Since the non-operating heating decreases the viscosity of the grease G applied to the heater 21, the frictional force between the heater 21 and the fixing film 22 is reduced, and the driving torque of the motor M when rotationally driving the fixing film 22 is reduced. The power (the first electric power) to be supplied for the non-operating heating may be sufficiently smaller than the maximum power that can be supplied to the heater 21 so as to prevent deformation, such as unevenness, of the fixing film 22 due to the temperature difference. After a predetermined time (in present embodiment, 0.5 second) has passed after the heater 21 is supplied with a power of 200 W, the control unit 50 outputs a motor driving signal to the motor M (E4). At that time, a delay time occurs from the timing at which the motor driving signal is transmitted until the motor M is actually driven to rotate the pressure roller 23 to start rotation of the fixing film 22. The delay time is difficult to estimate because it changes due to the state of the motor M, the wobbling or wearing of the gear (not illustrated) that transmits the driving force of the motor M to the pressure roller 23, the frictional force in the fixing nip N, or the like. For that reason, the rotation of the fixing film 22 itself needs to be sensed. To detect the rotation of the fixing film 22 in the present embodiment, after a driving signal is sent, the temperature of the fixing film 22 is sensed using the thermistor Th1 (E5). The temperature NT sensed by the thermistor Th1 hardly changes while the fixing film 22 is not rotating. When the rotation of the fixing film 22 is started, the heated area of the fixing film 22 heated by the heater 21 rotates to the sensing position of the thermistor Th1, so that the value of the sensed temperature NT increases. It is determined whether an increase ΔNT in the temperature NT sensed by the thermistor Th1 (the degree of temperature rise) after the driving signal is output to the motor M is equal to or greater than a threshold (E6). In the present embodiment, the threshold is set at 10° C. If the temperature increase ΔNT is less than the threshold, the fixing film 22 seems to be not rotating, and the process returns to E5. If the increase in temperature, ΔNT, is equal to or greater than the threshold, the fixing film 22 seems to be rotating, so that a power of 1,000 W (second electric power) is supplied to the heater 21 (E8), and the warm-up initial control ends (E9). In other words, in the present embodiment, the timing of starting supply of the second electric power to the heater 21 is determined according to the increase in temperature, ΔNT. Thereafter, a power of 1,000 W is continuously supplied until the temperature NT sensed by the temperature Th1 reaches the target temperature (the predetermined temperature) T (170° C.), and the warm-up is ended. In the present embodiment, the second electric power is set to the maximum power (1,000 W) of the heater 21, but the second electric power may be power nearly equivalent to the maximum power.

Warm-up initial control of the fixing apparatus 20 starts at the timing when the image forming apparatus 1 receives a print signal (E1). If the temperature of the heater 21 sensed by the thermistor Th2 is higher than the threshold temperature of the thermistor Th2 (E2), a driving signal is transmitted to the motor M (E7). After or at the same time the driving signal is transmitted, a power of 1,000 W is supplied to the heater 21 (E8). When the temperature sensed by the thermistor Th2 is higher than the threshold temperature, the temperature of the fixing film 22 is also high over the entire circumference. Therefore, even if the heater 21 is supplied with a power of 1,000 W in a state in which the rotation of the fixing film 22 stops, the difference in temperature between the area heated by the heater 21 and the non-heated area does not become so large that deformation of the fixing film 22 due to thermal stress hardly occurs. Furthermore, in the case where the heater 21 is supplied with a power of 1,000 W after or at the same time a driving signal is transmitted (E8), the timing when a power of 1,000 W is supplied to the heater 21 is earlier than in the case where the non-operating heating is performed (E3) or detection of the rotation of the fixing film 22 is performed (E6). This therefore advantageously reduces the time for the temperature sensed by the thermistor Th1 to reach the target temperature T, reducing the warm-up time of the fixing apparatus 20.

(5) Verifying Effects

The effects of the warm-up initial control of the present embodiment illustrated in FIG. 3 will be described by comparing the temporal changes of the present embodiment and a comparative example illustrated in FIGS. 4 and 5.

Figure 3:
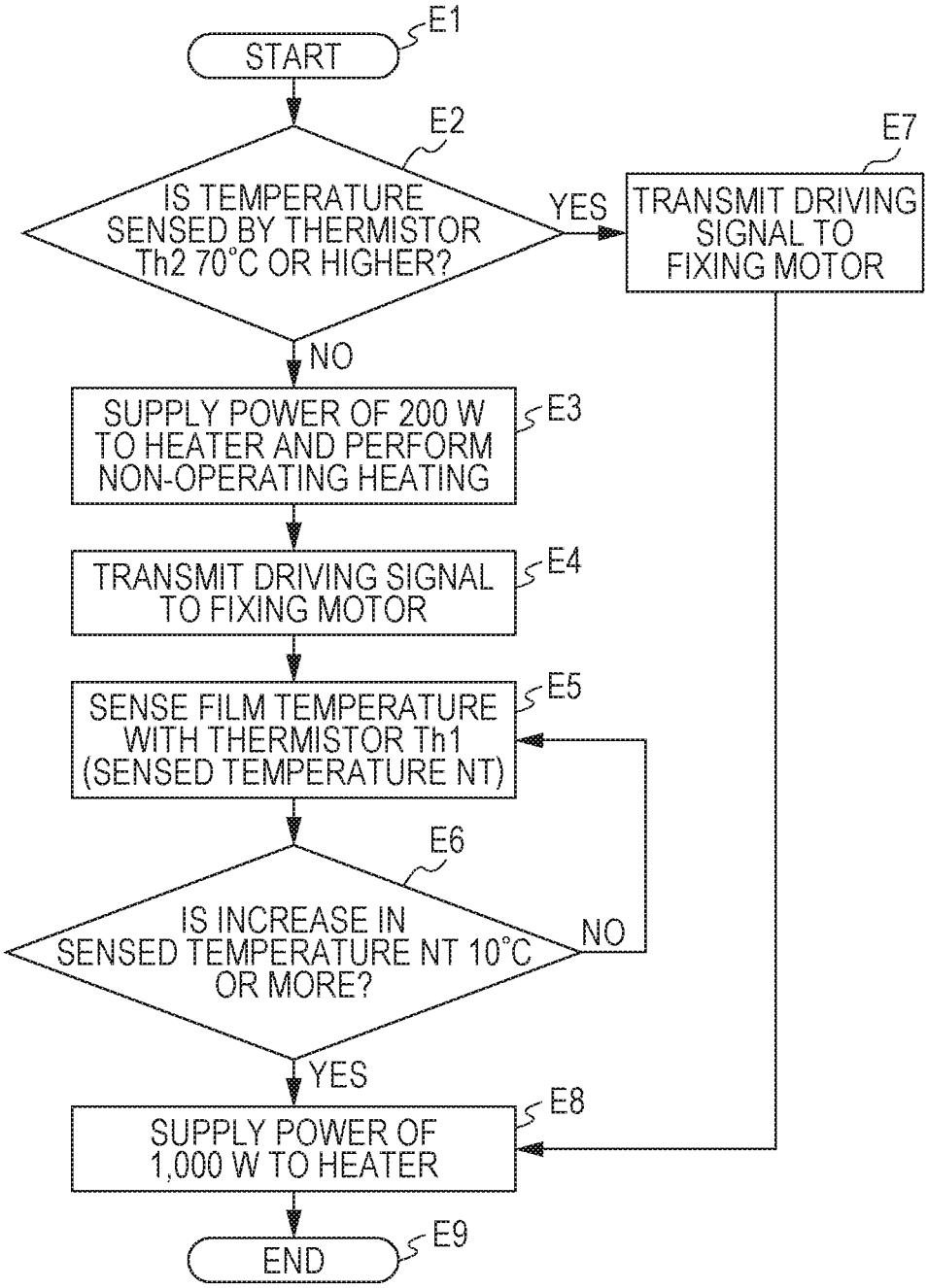
FIG. 3 is a flowchart for warm-up initial control according to the first embodiment.
Figure 4:
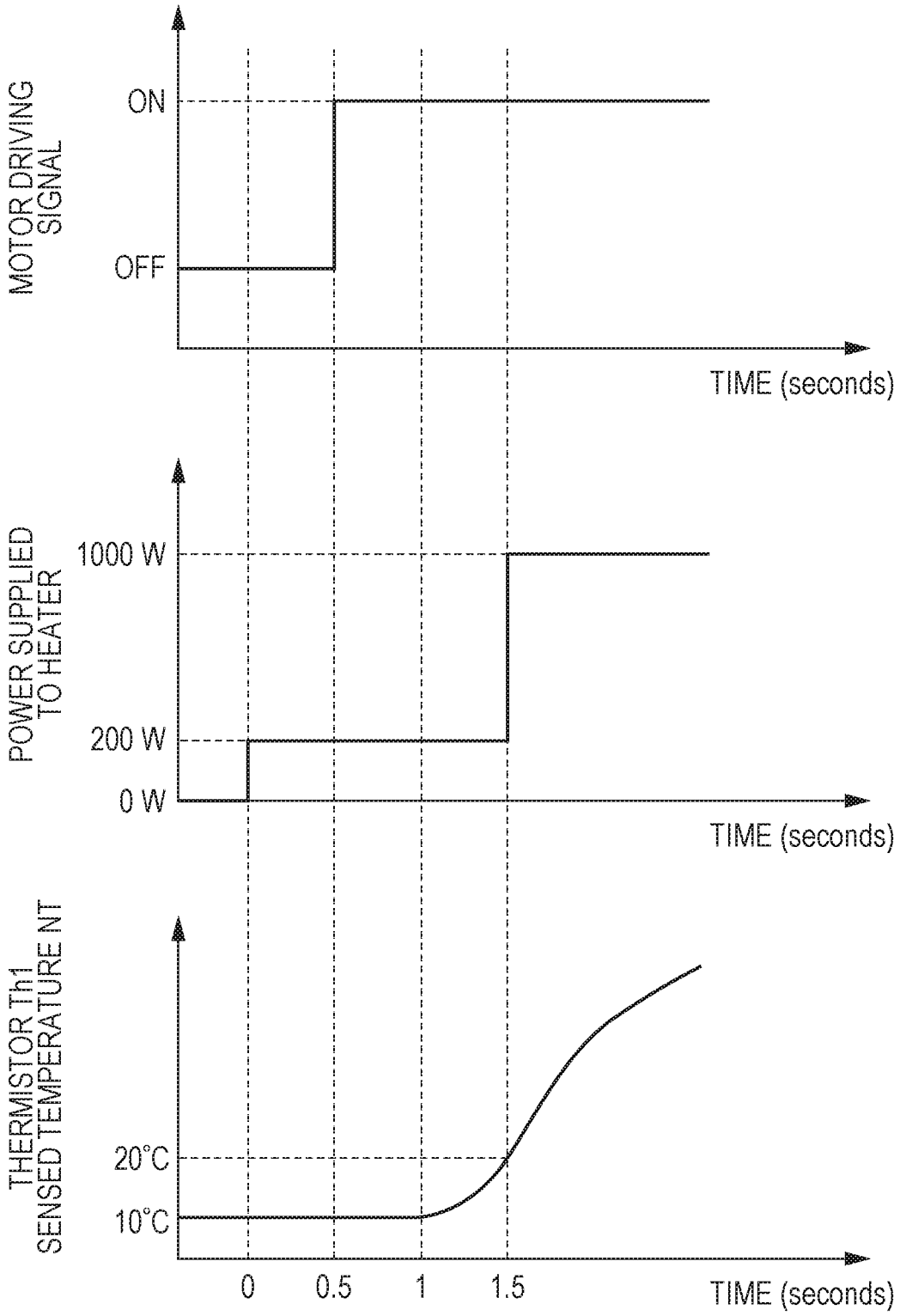
FIG. 4 illustrates graphs showing temporal changes of a motor driving signal, power supplied to the heater, and the temperature sensed by the thermistor during the warm-up initial control according to the first embodiment.
Figure 5:
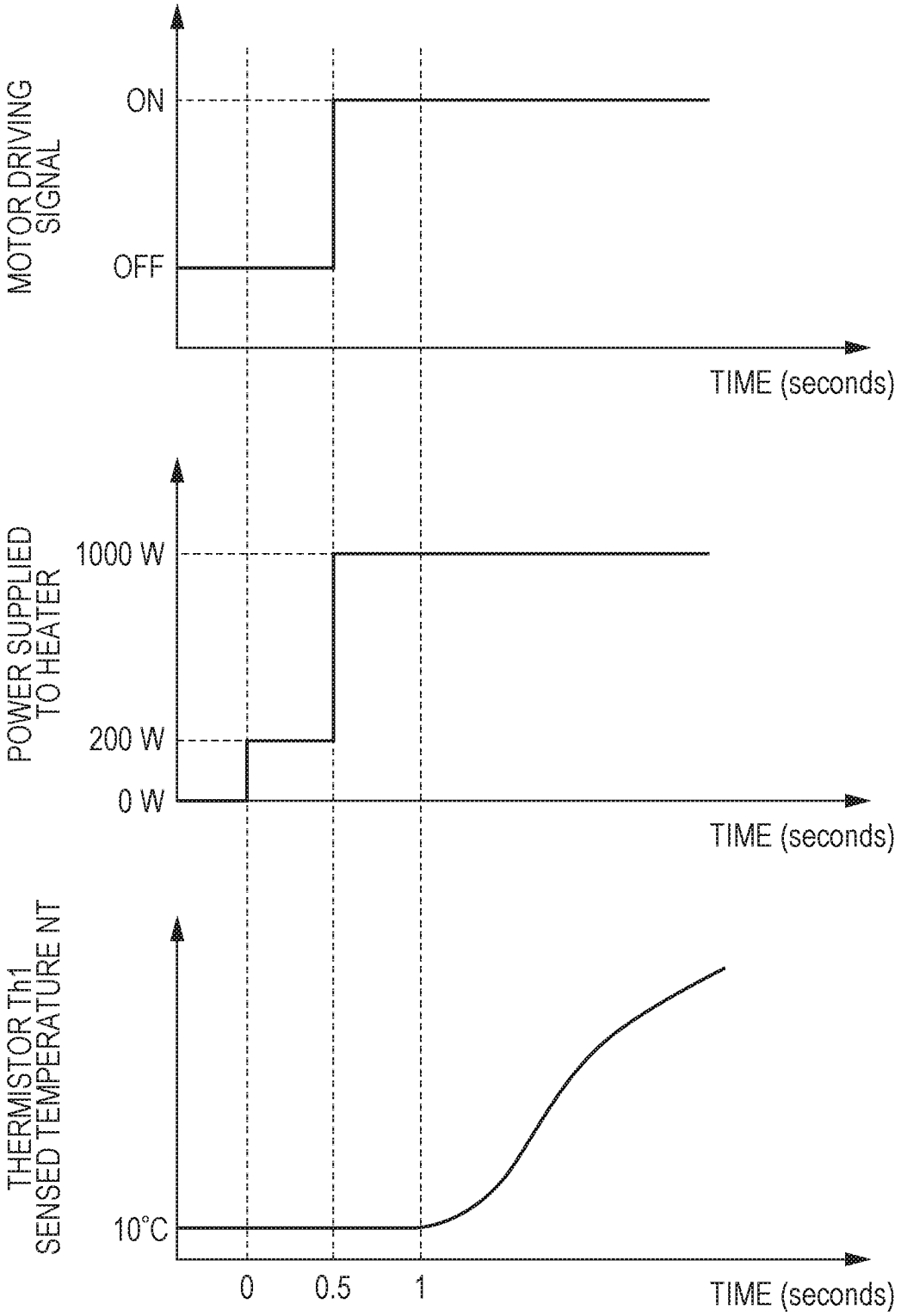
FIG. 5 illustrates graphs showing temporal changes of a motor driving signal, power supplied to the heater, and the temperature sensed by the thermistor during warm-up initial control in Comparative Example 1.

FIG. 4 illustrates graphs showing temporal changes of a motor driving signal, power supplied to the heater 21, and the temperature NT sensed by the thermistor Th1 of the fixing apparatus 20 left for a long time in a low-temperature environment (10° C.) during the warm-up initial control illustrated in FIG. 3.

Assuming that the timing when the fixing apparatus 20 starts the operation is 0 seconds, the heater 21 was supplied with 200 W at substantially the same timing as the timing, and the non-operating heating of the fixing film 22 was started. After 0.5 second, the motor driving signal was turned on, and when 1.0 second had elapsed, the sensed temperature NT began to rise. Since an increase in the sensed temperature NT, ΔNT, reached 10° C. or more when 1.5 seconds elapsed, the power supplied to the heater 21 was changed to 1,000 W.

In Comparative Example 1, the same fixing apparatus 20 as that of the present embodiment is used, but warm-up initial control of the fixing apparatus 20 differs. In Comparative Example 1, warm-up initial control of the fixing apparatus 20 does not include the steps E5 and E6 in the flowchart in FIG. 3. In other words, the rotation of the fixing film 22 is not detected. FIG. 5 illustrates graphs showing temporal changes of a motor driving signal, power supplied to the heater 21, and the temperature NT sensed by the thermistor Th1 of Comparative Example 1 during warm-up initial control. Assuming that the timing when the fixing apparatus 20 starts to operate is 0 seconds, as in FIG. 4, the heater 21 was supplied with 200 W at substantially the same timing as the timing, and the non-operating heating was started. After 0.5 second, the motor driving signal was turned on, and at the same time, the power supplied to the heater 21 was changed to 1,000 W.

However, actually, the sensed temperature NT starts to rise from around where one second has elapsed, and a time period during which 1,000 W was supplied in a state in which the fixing film 22 was not rotating occurred for 0.5 second. This causes an excessive temperature difference between the heated area and the non-heated area of the fixing film 22 to generate an excessive thermal stress in the fixing film 22. As a result, bumpy deformation may occur in the fixing film 22. To prevent such deformation of the fixing film 22, a delay time for always delaying the timing of increasing the power supplied to the heater 21 by a predetermined time may be set. However, the delay time needs to be set long for a situation in which driving members, such as gears, are most worn due to the termination of their useful lives, tolerances, or the like. This method is opposite to reducing the warm-up time, which is impractical.

As described above, the fixing apparatus 20 of the present embodiment offers the effect of preventing deformation of the fixing film 22 due to a thermal stress while reducing the warm-up time by detecting the rotation of the fixing film 22 to control the power of the heater 21 with a simple configuration.

In the present embodiment, when the temperature sensed by the thermistor Th2 is 70° C. or higher (E2) in FIG. 3, non-operating heating (E3) and detection of the rotation of the fixing film (E6) are not performed. However, the present disclosure is not limited thereto. In the case where the fixing apparatus 20 is warming, non-operating heating (E3) and the detection of the rotation of the fixing film (E6) may be performed regardless of the temperature sensed by the thermistor Th2.

Second Embodiment

The configurations of the image forming apparatus 1 and the fixing apparatus 20 of a third embodiment are the same as those of the first embodiment, and only warm-up initial control of the fixing apparatus 20 differs.

Figure 6:
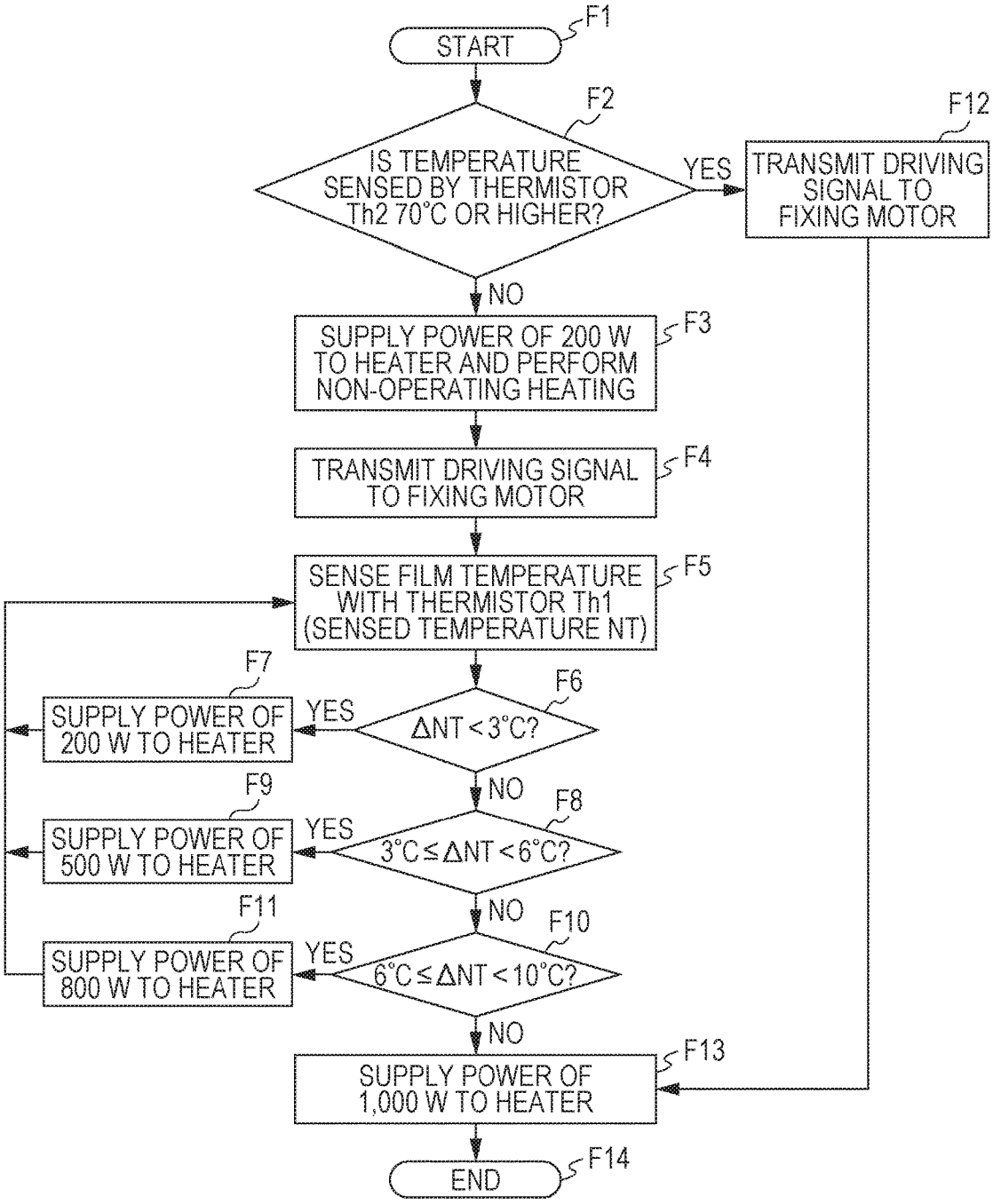
FIG. 6 is a flowchart for warm-up initial control according to a second embodiment of the present disclosure.

Warm-up initial control of the fixing apparatus 20 in the second embodiment will be described with reference to a flowchart in FIG. 6. Steps F1 to F5 and Steps F12 to F14 in FIG. 6 are respectively the same as Steps E1 to E5 and Steps E7 to E9 in FIG. 3 illustrating warm-up initial control of the first embodiment, and descriptions thereof will be omitted. Steps F6 to F11, which are the characteristics of the second embodiment, will be described. These steps are for determining power to be supplied to the heater 21 according to an increase ΔNT in the temperature NT sensed by the thermistor Th1. If the increase in temperature ΔNT is less than 3° C. (F6), the power to the heater 21 is kept at 200 W (F7), and the process returns to F5. If the temperature increase ΔNT is equal to or more than 3° C. and less than 6° C. (F8), the power to be supplied to the heater 21 is changed to 500 W (F9), and the process returns to F5. If the temperature increase ΔNT is equal to or more than 6° C. and less than 10° C. (F10), the power to be supplied to the heater 21 is changed to 800 W (F11), and the process returns to F5. If the increase in temperature ΔNT is equal to or more than 10° C. (F10), the power to be supplied to the heater 21 is changed to 1,000 W (F13).

As described above, the present embodiment reduces the warm-up time by gradually increasing the power to be supplied to the heater 21 according to the temperature increase ΔNT. After 1,000 W (the maximum power) is supplied (F13), the warm-up initial control is ended (F14). Thereafter, 1,000 W is continuously supplied until the temperature TN sensed by the thermistor Th1 reaches the target temperature (170° C.), and the warm-up is ended, and the fixing apparatus 20 enters a state in which fixing processing can be performed. If the power to the heater 21 has not reached 1,000 W, the process returns to F5.

Figure 7:
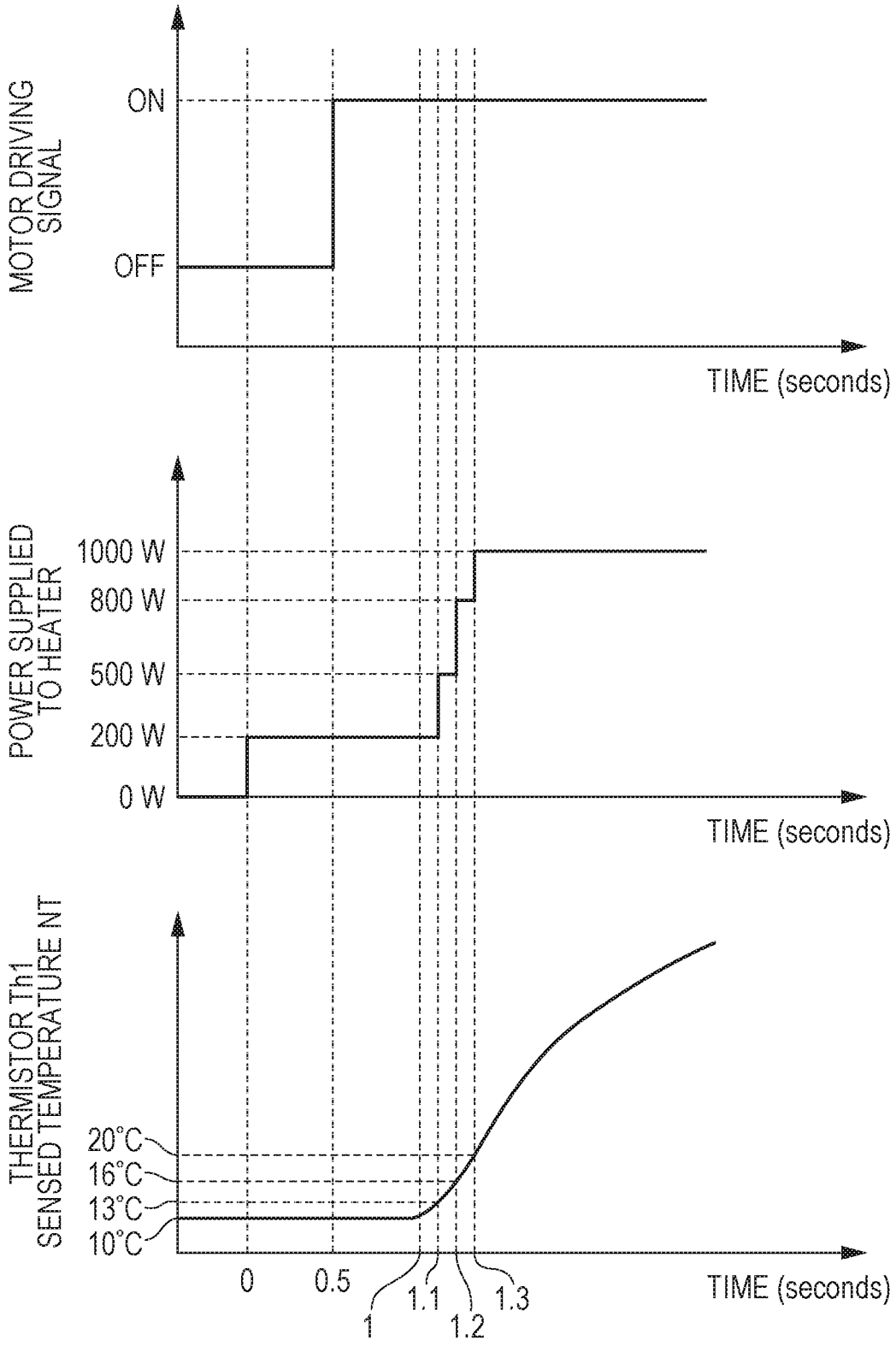
FIG. 7 illustrates graphs showing temporal changes of a motor driving signal, power supplied to the heater, and the temperature sensed by the thermistor during warm-up initial control according to the second embodiment.

FIG. 7 illustrates graphs showing temporal changes of a motor driving signal, power supplied to the heater 21, and the temperature NT sensed by the thermistor Th1 during warm-up initial control of the fixing apparatus 20. Assuming that the timing when the fixing apparatus 20 starts to operate is 0 seconds, the heater 21 was supplied with 200 W at substantially the same timing, and the non-operating heating was started. After 0.5 second, the motor driving signal was turned on. After 1.0 second, the temperature sensed by the thermistor Th1 started to rise. When the temperature increase ΔNT reached 3° C., the power to be supplied to the heater 21 was increased to 500 W. Likewise, the temperature increase ΔNT reached 6° C., the power to be supplied to the heater 21 was increased to 800 W, and when the temperature increase ΔNT reached 10° C., the power to be supplied to the heater 21 was increased 1,000 W. In the second embodiment, since the power to the heater 21 during the non-operating heating of the fixing film 22 is gradually increased, the timing of supplying 1,000 W (second electric power) can be made earlier by 0.2 second than that in the warm-up initial control of the first embodiment. As a result, the time taken for the temperature TN sensed by the thermistor Th1 to reach the target temperature (170° C.) is 5.0 seconds in the first embodiment, whereas it is 4.8 seconds in the present embodiment. Thus, the warm-up time can be reduced by 0.2 second.

The present embodiment has the advantageous effect of preventing deformation of the fixing film 22 due to a thermal stress while reducing the warm-up time by detecting the rotation of the fixing film 22 to control the power to the heater 21 with a simple configuration.

Third Embodiment

The configurations of the image forming apparatus 1 and the fixing apparatus 20 of a third embodiment are the same as those of the first embodiment, and only warm-up initial control of the fixing apparatus 20 differs.

Figure 8:
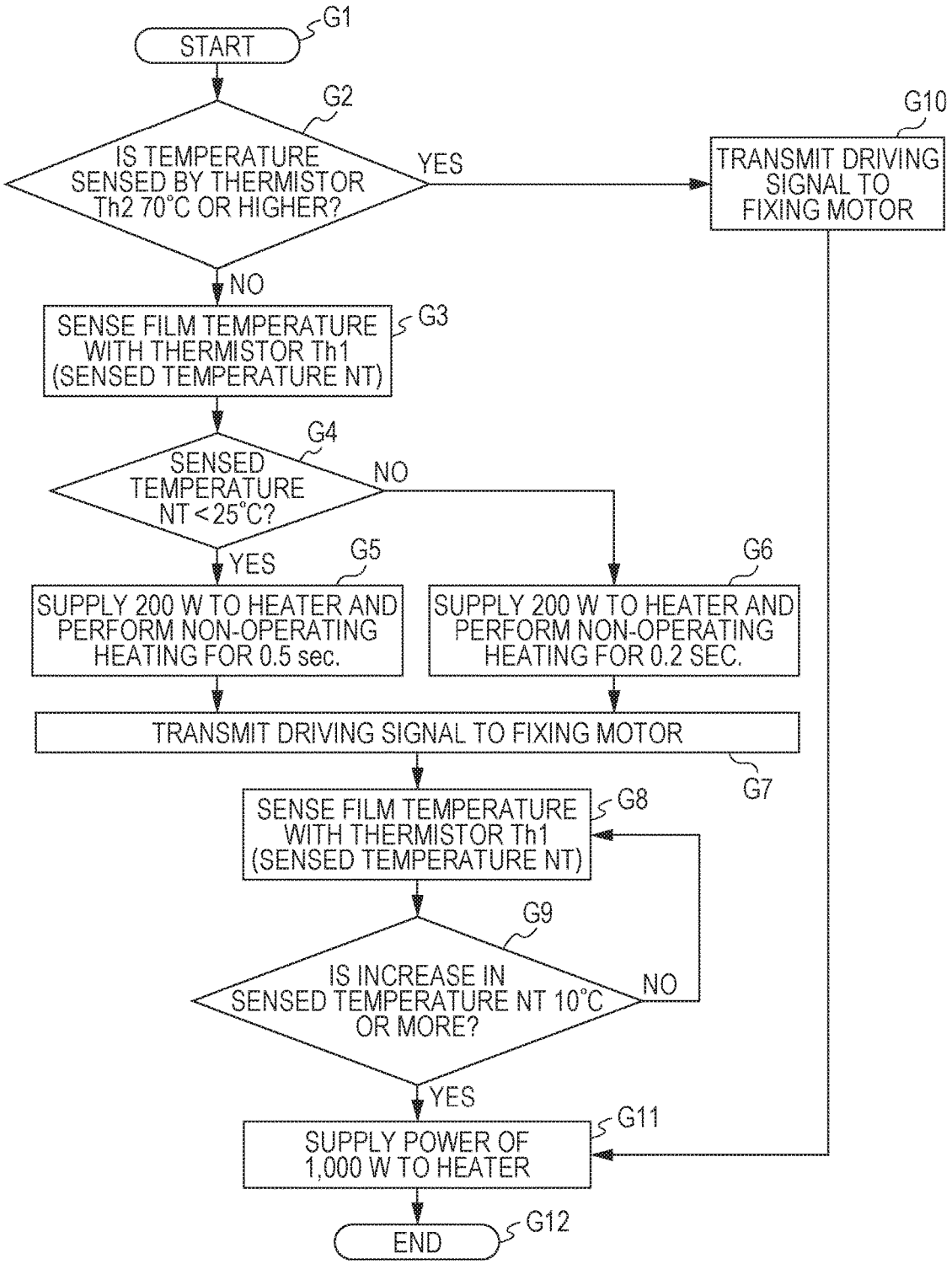
FIG. 8 is a flowchart for warm-up initial control according to a third embodiment of the present disclosure.

Warm-up initial control of the third embodiment will be described with reference to a flowchart in FIG. 8. Since steps G1, G2, and G7 to G12 in FIG. 8 are respectively the same as steps E1, E2, and E4 to E9 in the flowchart of the first embodiment (FIG. 3), descriptions thereof will be omitted. The characteristics of the present embodiment are G3 to G6 in FIG. 8.

Before a motor driving signal is transmitted to the motor M, the temperature of the fixing film 22 is sensed by the thermistor Th1 (G3). The time during which non-operating heating for supplying a power of 200 W to the heater 21, with the rotation of the fixing film 22 stopped, is determined as follows. If the temperature NT sensed by the thermistor Th1 is lower than 25° C. (G4), the time is set to 0.5 second (G5), and if the sensed temperature NT is higher than 25° C. (G4), the time is set to 0.2 second (G6). Thus, the period of the non-operating heating is changed according to the temperature of the fixing film 22 at the initial warm-up time during which the fixing film 22 is not heated and is not rotated. When the initial temperature of the fixing film 22 is high, the viscosity of the grease between the heater 21 and the fixing film 22 seems to be not so large. Therefore, by reducing the period of non-operating heating until the rotation of the fixing film 22 can be detected (in the present embodiment, 0.2 second), the warm-up time can be reduced (in the present embodiment, 0.3 second).

The present embodiment has the advantageous effect of preventing deformation of the fixing film 22 due to a thermal stress while reducing the warm-up time by detecting the rotation of the fixing film 22 to control the power to the heater 21 with a simple configuration.

Although the present embodiment uses the thermistor Th1 at step G3 in FIG. 8, any other temperature sensing member that allows the viscosity of the grease to be estimated may be used. For example, the thermistor Th2 for sensing the temperature of the heater 21 may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-191927 filed Sep. 29, 2017, which is hereby incorporated by reference herein in its entirety.

What is claimed is:

1. A fixing apparatus comprising:

a rotatable tubular film;

a heater in contact with part of an inner surface of the film in a rotational direction of the film;

a temperature sensing member configured to sense a temperature of the inner surface of the film at a position different from a position of the heater in the rotational direction of the film;

a driving source configured to generate a driving force for rotating the film; and a control unit configured to control a driving signal to be transmitted to the driving source and electric power to be supplied to the heater, wherein the fixing apparatus fixes an image formed on a printing material to the printing material using heat of the heater via the film, wherein, in a warm-up period of the fixing apparatus, the control unit supplies first electric power to the heater and thereafter supplies second electric power larger than the first electric power to the heater, and wherein a timing of starting to supply the second electric power is determined according to a degree of an increase in temperature sensed by the temperature sensing member after the driving signal is transmitted to the driving source.

2. The fixing apparatus according to claim 1, wherein, during a fixing process for fixing the image to the printing material, the control unit controls the electric power to be supplied to the heater to bring the temperature sensed by the temperature sensing member to a predetermined temperature.

3. The fixing apparatus according to claim 1, further comprising a roller configured to form a nip, through which a printing material is conveyed, together with the heater, with the film therebetween.

4. The fixing apparatus according to claim 1, further comprising:

a second temperature sensing member configured to sense the temperature of the heater, the temperature sensing member being a first temperature sensing member, wherein during the warm-up period, when a temperature of the heater sensed by the second temperature sensing member before the heater is supplied with the first electric power is lower than a threshold temperature, the heater is supplied with the first electric power and thereafter supplied with the second electric power, wherein a supply start timing of the second electric power after electric power is supplied to the driving source is determined according to a degree of increase in the temperature sensed by the first temperature sensing member, and when the temperature of the heater sensed by the second temperature sensing member before the heater is supplied with the first electric power is higher than the threshold temperature, the heater is supplied with the second electric power simultaneously with or immediately after electric power is supplied to the driving source.

5. The fixing apparatus according to claim 4, wherein the second temperature sensing member is disposed in an area through which a small-size printing material passes.

6. The fixing apparatus according to claim 1, wherein the control unit sets a size of the second electric power in accordance with the degree of an increase in temperature.

7. The fixing apparatus according to claim 6, wherein if the degree of an increase in temperature is a first degree, the control unit sets the second electric power to a first size, and if the degree of an increase in temperature is a second degree larger than the first degree, the control unit sets the second electric power to a second size larger than the first size.

8. The fixing apparatus according to claim 3, wherein the film is rotated by the roller which is driven by the driving source.

9. A fixing apparatus comprising:

a rotatable tubular film;

a heater in contact with part of an inner surface of the film in a rotational direction of the film;

a temperature sensing member configured to sense a temperature of the inner surface of the film at a position different from a position of the heater in the rotational direction of the film;

a driving source configured to generate a driving force;

a roller configured to form a nip, through which a printing material is conveyed, together with the heater, with the film therebetween, the roller is driven by the driving source; and a control unit configured to control a driving signal to be transmitted to the driving source and electric power to be supplied to the heater, wherein the film is rotated by the roller, wherein the fixing apparatus fixes an image formed on a printing material to the printing material using heat of the heater via the film at the nip, wherein, in a warm-up period of the fixing apparatus, the control unit supplies first electric power to the heater and thereafter supplies second electric power larger than the first electric power to the heater, and wherein when a degree of an increase in temperature sensed by the temperature sensing member reaches a threshold temperature after the driving signal being transmitted to the driving source, the control unit changes the electrical power supplied to the heater from the first electric power to the second electric power.

10. The fixing apparatus according to claim 9, wherein, during a fixing process for fixing the image to the printing material, the control unit controls the electric power to be supplied to the heater to bring the temperature sensed by the temperature sensing member to a predetermined temperature.

11. The fixing apparatus according to claim 9, further comprising:

a second temperature sensing member configured to sense the temperature of the heater, the temperature sensing member being a first temperature sensing member, wherein during the warm-up period, when a temperature of the heater sensed by the second temperature sensing member before the heater is supplied with the first electric power is lower than a threshold temperature, the heater is supplied with the first electric power and thereafter supplied with the second electric power, wherein a supply start timing of the second electric power after electric power is supplied to the driving source is determined according to a degree of increase in the temperature sensed by the first temperature sensing member, and when the temperature of the heater sensed by the second temperature sensing member before the heater is supplied with the first electric power is higher than the threshold temperature, the heater is supplied with the second electric power simultaneously with or immediately after electric power is supplied to the driving source.

12. The fixing apparatus according to claim 11, wherein the second temperature sensing member is disposed in an area through which a small-size printing material passes.

* * * * *